United States Patent [19]

Langlois et al.

[11] Patent Number: 4,667,444

[45] Date of Patent: May 26, 1987

[54] CONTROL DEVICE FOR LIFTING-UP AND TRANSLATING THE CARRIAGE OF A MACHINE FOR EDGE TRIMMING AND BEVELING SPECTACLE GLASSES

[75] Inventors: Jean-Pierre Langlois, Cleon; Bernard Verdier, Elbeuf, both of France

[73] Assignee: Briot International, France

[21] Appl. No.: 722,264

[22] Filed: Apr. 11, 1985

[30] Foreign Application Priority Data

Apr. 12, 1984 [FR] France ..... 84 05808

[51] Int. Cl.[4] ..... B24B 9/14; B24B 17/02

[52] U.S. Cl. ..... 51/101 LG; 51/284 E

[58] Field of Search ..... 51/97 NC, 101 LG, 105 EC, 51/165.79, 165.89, 284 E

[56] References Cited

U.S. PATENT DOCUMENTS

| | | | |
|---|---|---|---|
| 3,513,598 | 5/1970 | Asselin et al. | 51/101 LG |
| 4,195,445 | 4/1980 | Bardonnet | 51/101 LG |
| 4,383,393 | 5/1983 | Takubo | 51/101 LG |

FOREIGN PATENT DOCUMENTS

| | | | |
|---|---|---|---|
| 2481635 | 11/1981 | France | 51/101 LG |
| 181556 | 10/1983 | Japan | 51/101 LG |
| 2041800 | 9/1980 | United Kingdom | 51/101 LG |

*Primary Examiner*—Robert P. Olszewski

*Attorney, Agent, or Firm*—McGlew and Tuttle

[57] ABSTRACT

Automatic control device for lifting-up and translating a carriage of a machine for edge trimming and beveling spectacles glasses, of the type wherein the shaft supporting the glass includes a cam acting on a switch so to as to control stopping of the glass rotating motion, and a motor driving the carriage with a translational motion by a cam, wherein it comprises first elements (16,17) allowing operation of the lifting-up mechanism, second elements (27) for guiding the lowering motion of the carriage (1) and third elements (22,23) constituting a mechanical storage for moving the carriage (1) on one hand along a curved path during lifting-up and lowering, corresponding to the mean curvature of the glass, and on the other hand with a simultaneous additional translational movement.

6 Claims, 6 Drawing Figures

CONTROL DEVICE FOR LIFTING-UP AND TRANSLATING THE CARRIAGE OF A MACHINE FOR EDGE TRIMMING AND BEVELING SPECTACLE GLASSES

BACKGROUND OF THE INVENTION

This invention relates to automatic machines for edge trimming and beveling spectacle glasses, and more particularly relates to an improved automatic control device for lifting-up and translating operations in such a machine.

Machines for edge trimming and beveling spectacle glasses include a generally U-shaped carriage rotatably and slidingly mounted on a shaft extending through an intermediate part of said carriage, perpendicularly to the flanges thereof. A second rotating shaft comprised of two parts, each of which extends through one of said carriage flanges, is in parallel relationship with the first shaft and supports between its inner ends the spectacle glass to be treated. A jig is affixed to an end of one of the half-shafts.

A group of working grinding wheels is supported on a third shaft which is in parallel relationship with the first and second shafts and comprises a first flat rough grinding wheel and a finishing groove having a V-shaped cross-section.

A lifting-up and translation mecanism acts on the carriage so as to lower the glass to be trimmed against the rough grinding wheel, whereas the jig limits the lowering of the carriage by taking its bearing on a first rough-shaping stop, then that mechanism lifts up the glass with a pivoting motion about the first shaft, causes the carriage to translate to bring the glass above the finishing groove of the grinding wheel and finally lowers said glass to bring its edge into contact within said finishing groove of the grinding wheel, whereas the jig comes to rest on a second finishing stop when treatment of the glass is completed.

In machines of that kind heretofore known, the device which controls lifting-up and lowering of the glass onto the grinding wheels ensures said motions along a vertical path and also in any angular position of the glass.

Curvature changes of the glasses, which depend on the type of correction to be achieved, as well as diameter changes of these glasses however alter the lateral falling position of the glass edge entering the grinding wheel groove, which has serious diadvantages:

the lateral positions of the glass on the rough grinding wheel differ depending on its curvature and diameter, with the result that it is not easy to adjust the lateral position of the carriage above the rough grinding wheel and also causing an irregular wear of the grinding wheel throughout its width;

the edge of the glass does not fall always exactly in front of the groove of the wheel and during lifting-up the glass can be put in frictional engagement against one of the faces of the wheel groove, which results in marks or chamfers appearing on the bevel edges;

moreover when it is desired to make retouches on the glass on the finishing grinding wheel, said glass does not always present exactly the same face towards the finishing groove, which results in markings that only could be avoided through a manual adjusting or guiding operation so as to bring the glass edge directly opposite the finished groove.

SUMMARY OF THE INVENTION

The object of the present invention is to overcome these disadvantages by means of a control device for a machine for edge trimming and translating the spectacle glasses which permits a uniform engagement of the glass against the rough grinding wheel and which presents said glass exactly opposite the finishing groove of the wheel.

To that end, the invention relates to an automatic control device for lifting-up and translating a carriage of a machine for edge trimming and beveling spectacle glasses, of the type wherein the shaft supporting the glass includes a cam acting on a switch so as to control stopping of the glass rotating motion, and a motor driving the carriage with a translational motion by means of a cam, characterized in that it comprises first means allowing operation of the lifting-up mecanism, second means for guiding the lowering motion of the carriage and third means for moving the carriage on one hand along a curved path during liftingup and lowering, corresponding to the mean curvature of the glass, and on the other hand with a simultaneous additionnal translational movement.

BRIEF DESCRIPTION OF THE DRAWINGS

The following description may be more clearly understood and readily carried into effect with reference to the accompanying drawings given as non limitating examples of the invention, in which.

DETAILED DESCRIPTION OF THE INVENTION

Figure 1:
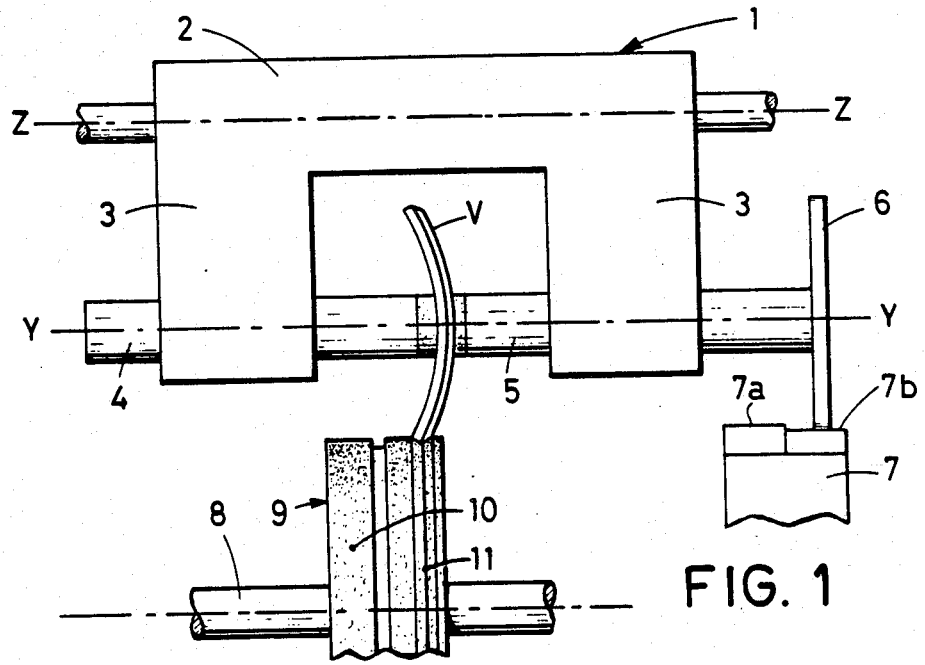
FIG. 1 is a diagrammatic overall view on a machine for edge trimming and beveling spectacle glasses of classical type to which the invention can be applied.

Referring to FIG. 1, the classical type of machine comprises a carriage 1 being generally U-shaped with an intermediate part 2 and two parallel branches or flanges 3 extending perpendicularly at opposite sides of the intermediate part 2.

The carriage 1 is rotatably and slidingly mounted on a mounting shaft or axis Z—Z extending along the longitudinal axis of the intermediate part, perpendicularly to the two lateral flanges 3 of the carriage. A second or clamping shaft is comprised of two aligned parts 4,5 along on axis Y—Y in parallel relationship to the axis Z—Z and each extending through an end part of a flange 3 of the carriage.

The inner ends of the shaft parts 4 and 5 include a block of flexible material and the glass V to be worked is clamped between these blocks. The two shaft parts 4, 5 rigidly jointed together by clamping the glass V, are put into rotation so as to cause rotation of the glass V about axis Y—Y.

As known per se, the shaft 4,5 supports a cam 14 (FIG. 2) controlling a micro-switch 15 so as to stop the glass rotation in a given position which usually corresponds to the smallest radius of the glass.

One of the parts of said shaft, part 5, supports at its outer end a jig 6. Jig 6 has a shape corresponding to a frame for glass V, and in operation, rests on a stop 7 having two bearing surfaces 7*a* and 7*b*.

A third shaft 8 with an axis parallel to axes Y—Y and Z—Z supports a group of grinding wheels 9 which are rotatably mounted and having, for example, a rough-shaping flat portion 10 and a finishing groove 11 with a V-shaped cross section.

It is to be noted that in FIG. 1 axes Z—Z and Y—Y are shown as being in superposition for the sake of clarity in the drawing, while axis Y—Y and Z—Z of both shafts really approximatively lie at the same level.

Figure 2:
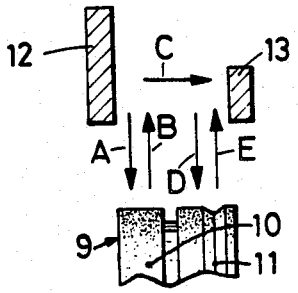
FIG. 2 is a diagram showing a working cycle of machine of FIG. the 1.

FIG. 2 shows the classical working cycle of such a known machine.

The carriage 1 in a lifted position, i.e. in which the edge of the glass V is raised above the grinding wheel 9, is put by translation along the axis Z—Z in contact with a stop 12 disposed in such a manner that when the control mechanism causes the shaft 4,5 to lower as indicated by an arrow A in FIG. 2, the glass moves down towards the surface 10 of the grinding wheel 9 driven in rotation whereas the shaft 4,5 is also driven in slow rotation, and a limitation applied to the carriage lowering is ensured by the jig 6, the shape of which corresponds to that of the finished glass and which rests on the bearing surface 7*a*.

When the rough-shaping work is completed, the control mechanism causes the shaft 4,5 to raise as indicated with an arrow B in the FIG. 2, then causes the carriage 1 to translate as indicated with an arrow C for bringing same into contact with a second stop 13 disposed in such manner that the control mechanism causes the shaft 4,5 to move down as indicated with an arrow D, and the stop 13 is retracted during the finishing work in the groove 11 in order that the glass edge freely positions itself according to the direction of the carriage translation and that the bevel is formed with a shape as regular as possible throughout all the periphery of the glass, the jig 6 being then restricted for lowering any further by the surface 7*b* of the stop 7. When the beveling work is completed, the mechanism causes the shaft 4,5 to raise according to the arrow E of FIG. 2.

It is to be noted that in that classical working cycle, lowering and lifting-up movements of the carriage are executed vertically with the glass being in any angular position.

As above indicated, the curvature change of the glasses modify the lateral position of falling thereof into the groove of the grinding wheels so that it is not possible to smoothly grind the edge of the glass. The glass does not always fall exactly in front of the desired groove and moreover during lifting-up a part of the glass can come into contact with a side of the groove 11 resulting in a chamfer or a marking on the edge of the bevel.

Also when it is desired to make a retouch operation on a glass using the groove 11, it is necessary to effect a manual highly accurate adjusting or grubling operation so as to avoid formation of a marking or a chamfer on the edge of the bevel.

Figure 3:
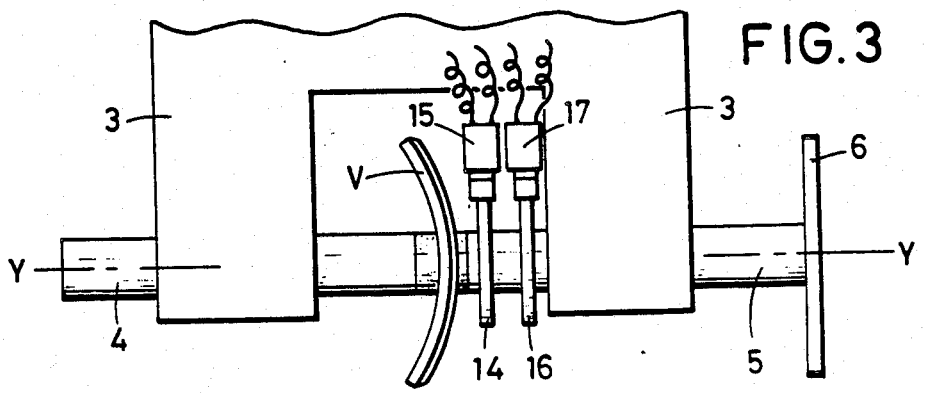
FIG. 3 is a partial view showing a part of the device according to the invention, provided on one of the half shafts supporting the glass to be treated.

According to a characteristic of the invention which is shown in FIG. 3, a second cam 16 is provided on the shaft 4,5 which is locked in rotation with the part 5 of the shaft, and a micro-switch 17 adapted to be activated through the ramp of the cam 16.

The micro-switch 17 is connected to the other known usual contact parts of the lifting-up mecanism and allow that lifting motion of the carriage only at the vicinity of the stopping position of the glass, this being achieved by means of a predetermined angular shifting of cams 14 and 16.

Thanks to this cam system, changes of lateral positioning of the glass due to diameter changes thereof according to its angular position on the shaft 4,5 are obviated.

Figure 4:
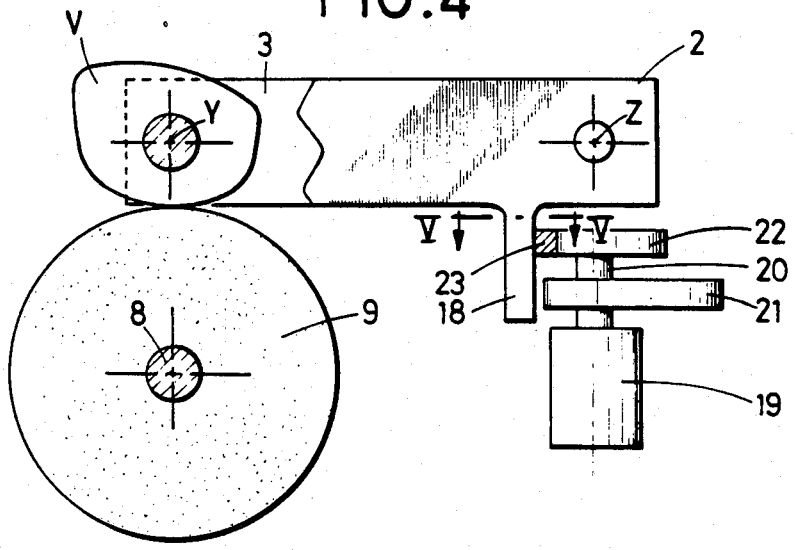
FIG. 4 is an end view, partially in section, of a second part of the device according to the invention.
Figure 5:
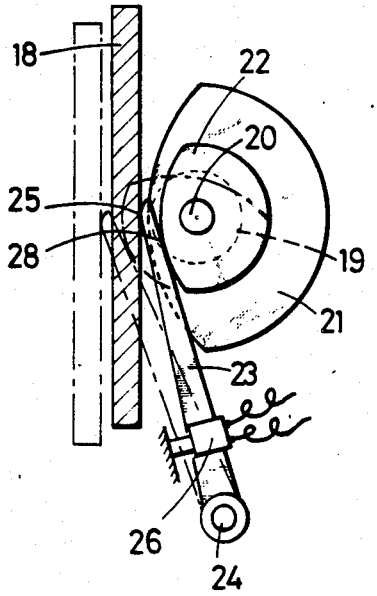
FIG. 5 is a sectional view taken along V—V of FIG. 4.

Reference is now made to FIGS. 4 and 5 showing the arrangement of another part of the device according to the invention.

FIG. 4 shows that the intermediate part 2 of the carriage 1 includes a integral stop 18 comprised of a rib projecting under the carriage 1 and extending in parallel relationship with the axis Z—Z while protruding under the carriage.

A reversible micromotor 19 with reduction gear is provided so that its output shaft 20 extends in parallel relationship with the stop 18 in the direction to axis Z—Z. The shaft 20 supports, as known per se, the cam 21.

The cam 21 driven by the shaft 20 is shaped in order that its ramp engages the stop 18 located between axes Z—Z and Y—Y so as to cause a translation of the carriage being driven by effect of friction. For this purpose, the ramp of the cam 21 so provided with a coating (not shown) having a sufficient friction coefficient in the area of the ramp mount to engage stop 18.

According to the invention, a second cam 22 is provided on the motor shaft 20.

The cam 22, also locked in rotation with the shaft 20 of the motor 19, has such a profile that it does not directly engage the stop 18, a lever 23 being interposed between its ramp and the stop 18.

The lever 23 is comprised of an arm linked at one end on a fixed pin 24. The opposite end of lever 23 engages with its end part 25 against the stop 18. This end of the arm extends between the ramp of the cam 22 and the stop, with a small backlash therebetween and the end part 25 comprise means for preventing it from sliding on the stop 18, e.g., a material having a high friction coefficient is provided on end part 25.

The lever arm 23 is moreover connected to a micro-switch 26 controlling the operation of driving (rotating) the shaft 4,5 supporting the glass, only when the arm engages the stop.

Figure 6:
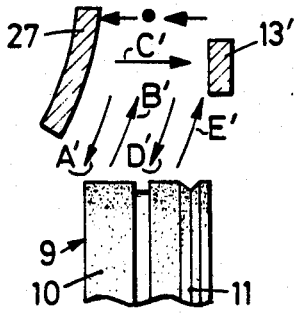
FIG. 6 diagramatically shows a working cycle of the machine fitted with a working the control device according to the invention.

Finally according to another characteristic of the invention, when the cam 21 is driving the carriage in translation along the axis Z through frictional engagement of its ramp against the stop 18, the carriage engages a stop 27 shown in FIG. 6, which not only is slanted outwardly with respect to the end of the carriage, but also is curved so as to essentially correspond to the mean incurvation of the spectacle glasses. Stop 27 serves the same purpose as stop 12 in FIG. 2, but has an improved effect on the operation.

The function of the device is as follows. When the carriage in a raised condition is driven in translation along to the axis Z—Z through frictional engagement of the ramp of the cam 21 against the stop 18, the carriage comes into contact with the curved stop 27 (FIG. 6) which guides the lowering motion of the glass along a curved path A′ onto the rough grinding wheel 10. When the glass trimming operation with said wheel is completed, an automatic known device using cam 14 and micro-switch 15 (FIG. 3) causes the glass to stop in position. The driving motor 19, which had moved cam 21 to raise and translate the carriage, now moves and the cam 22 which acts on the stop 18 through the end of the lever 23, which end 25 runs along a circular arc while resting on the stop 18. The amplitude of this circular movement causes simultaneously with the lifting-up of the carriage, a translational movement thereof which in practice corresponds to the mean curvature of the glass. This translation is due to the fact that the end 25 of the lever does not slide on the stop 18.

As known per se, when the motor 19 reverses, the cam 21 brings the carriage back into contact with the stop 13 and acts no more on said stop 18. The cam 22 is then put in action in a similar manner as above, but in the reverse sense so as to cause the glass to lower along a path corresponding to a mean curvature thereof, exactly in the finishing groove 11.

When that finishing operation is completed, the ramp of the cam 16 activates the microswitch 17 in order to allowing the same mechanism as above to carry in effect lifting-up by activating the motor 19 with a lead corresponding to the time delay necessary to compensate the backlashes, i.e. just when the lifting-up motion begins.

That lead is fixed by appropriate shift between cams 14 and 16, the former stopping the glass in a predetermined fixed position.

In the case operation for a retouch of the glass, the same process is carried out in the reverse sense and the glass falls again into the groove 11 exactly in the same position.

It is essential to note that there is no relative sliding movement of the end 25 of the lever 23 and the stop 18 therebetween, said parts thus moving together in translation.

To execute the complete operation cycle of FIG. 6 similar to that shown in FIG. 2, the motor 19 is of the reversible type as indicated above and the different movements are indicated in the FIG. 6 by arrows designated by same references as in FIG. 2 but with a prime (e.g. B').

During the lowering of the carriage, the motor 19, the cam 22 and the lever 23 follow the same path in the reverse direction and the micro-switch 26 enables the shaft 4,5 to rotate, resulting in driving the glass when same is in contact with the grinding wheel. So it is the same glass area which moves away from the wheel when being lifted up and when it comes back down, so ensuring a proper carriage position. One understands that motor 19, cams 21,22 and lever 23 form together a mechanical storage allowing in the case of retouches to ensure an accurate falling-back of the glass into the groove 11 of the grinding wheel 9 so avoiding any ajustment of the lateral position and suppressing the hazards of production of markings of chamfers in the bevel of the glass.

It is to be noted that the length of the lever 23 defines the amplitude of the mean curvature of the glass. Consequently it is possible to provide a interchangeable group of levers 23 of different lengths, or still a lever 23 of adjustable length in order to correspond to spectacle glasses having different curvatures.

FIG. 5 shows with a chain-dotted line the positions reached by stop 18 and lever 23 and putting into evidence the additional translational motion corresponding to the mean curvature of a glass.

What is claimed is:

1. In combination with a machine for edge trimming and beveling a spectacle glass having a mean curvature and an outer edge, the machine comprising a mounting shaft having a first axis, a carriage mounted on said mounting shaft having shaft for rotation about and translation along said first axis, a clamping shaft mounted for rotation about a second axis to said carriage at a location spaced from the first axis, the first and second axes being parallel to each other, said clamping shaft being adapted to carry a spectacle glass for rotation about the second axis, a grinding wheel mounted for rotation at a location spaced from the second axis for being engaged by the outer edge of a spectacle glass for grinding the outer edge, shaft rotation means operatively connected to said clamping shaft for rotating said clamping shaft about the second axis, a first rotation stopping cam connected to said clamping shaft for influencing said shaft rotation means to stop rotation of said clamping shaft at a selected angular position, the improvement comprising;

a motor having a motor shaft;

a lifting cam connected to said motor shaft;

said carriage having a lifting stop extending outwardly therefrom and parallel to the first and second axes, said lifting cam being engageable with said lifting stop for simultaneously rotating and translating said carriage on the first axis for lifting a spectacle glass held by said clamping shaft away from said grinding wheel;

first means operatively connected to said clamping shaft for activating said motor when said clamping shaft reaches its selected angular position so as to cause said motor shaft to rotate to lift and translate a spectacle glass held by said clamping shaft;

second means operatively connected to said carriage for guiding a pivotal and translational movement of said carriage with respect to the first axis during a lowering of said clamping shaft in order to follow a curved path corresponding to said mean curvature of a spectacle glass held by said clamping shaft;

third means operatively connected to said motor and cooperating with said second means for lifting and lowering said clamping shaft by rotating said carriage and for translating said clamping shaft by translating said carriage with respect to the first axis, so that said carriage follows said curved path corresponding to said mean curvature, said third means acting on said carriage to translate said carriage in addition to translation of said carriage caused by said lifting cam, said third means comprising a second lifting cam fixed to said motor shaft and a lever mounted for movement adjacent said lifting stop and engaged by said second lifting cam for moving said lever into engagement with said lifting stop for rotating and translating said carriage on the first axis to move said carriage in the curved path corresponding to said mean curvature.

2. A combination according to claim 1 wherein said first means comprises a second cam fixed to said clamping shaft, a first micro-switch mounted for engagement by said second cam, said first micro-switch being connected to said motor for activating said motor when said clamping shaft moves to its selected angular position, said first rotation stopping cam and said second cam being fixed to said clamping shaft at a selected offset position so that said second cam activates said first micro-switch slightly in advance of said clamping shaft reaching its selected angular position.

3. A combination according to claim 1 wherein said second means comprises a curved stop positioned to engage said carriage when said carriage is pivoted to lower said clamping shaft, said curved stop having a shape corresponding to the mean curvature of a spectacle glass held by said clamping shaft.

4. A combination according to claim 1 including a fixed pin, said lever having one end mounted to said fixed pin and an opposite end, said opposite end of said lever being for contact with said lifting stop, said second lifting cam being engaged with said lever at a location thereon intermediate said fixed pin and said opposite end.

5. A combination according to claim 4 wherein said lever has a high friction material on its opposite end for engagement with said lifting stop.

6. A combination according to claim 5 including a second micro-switch operatively connected to said lever and connected to said shaft rotation means for enabling said shaft rotation means to prevent rotation of said clamping shaft only when said second lifting cam has lowered and translated said clamping shaft.

* * * * *